US010946937B2

(12) United States Patent
Gug

(10) Patent No.: US 10,946,937 B2
(45) Date of Patent: Mar. 16, 2021

(54) AUTO-RELEASABLE NEW DANGER MARK BUOY

(71) Applicant: KOREA MARITIME UNIVERSITY INDUSTRY-ACADEMIC COOPERATION FOUNDATION, Busan (KR)

(72) Inventor: Seung Gi Gug, Busan (KR)

(73) Assignee: KOREA MARITIME UNIVERSITY INDUSTRY-ACADEMIC COOPERATION FOUNDATION, Busan (KR)

( * ) Notice: Subject to any disclaimer, the term of this patent is extended or adjusted under 35 U.S.C. 154(b) by 0 days.

(21) Appl. No.: 16/490,788

(22) PCT Filed: Mar. 2, 2017

(86) PCT No.: PCT/KR2017/002276
§ 371 (c)(1),
(2) Date: Sep. 3, 2019

(87) PCT Pub. No.: WO2018/159876
PCT Pub. Date: Sep. 7, 2018

(65) Prior Publication Data

US 2020/0017172 A1 Jan. 16, 2020

(51) Int. Cl.
*B63B 22/08* (2006.01)
*B63C 7/26* (2006.01)

(52) U.S. Cl.
CPC ..... *B63B 22/08* (2013.01); *B63C 7/26* (2013.01)

(58) Field of Classification Search
USPC ..... 441/1, 6, 7, 10, 11, 13, 21, 22, 23, 24, 441/25, 26, 27, 32
See application file for complete search history.

(56) References Cited

U.S. PATENT DOCUMENTS 3,702,014 A * 11/1972 Rabon ..... B63B 22/003 441/6
4,721,486 A * 1/1988 Goettel ..... B63C 7/26 251/294

(Continued)

FOREIGN PATENT DOCUMENTS

KR 10-2003-0086493 A 11/2003
KR 10-2011-0113537 A 10/2011

(Continued)

OTHER PUBLICATIONS

International Search Report for PCT/KR2017/002276 dated Nov. 13, 2017.

*Primary Examiner* — Daniel V Venne
(74) *Attorney, Agent, or Firm* — The PL Law Group, PLLC

(57) ABSTRACT

A buoy system according to one embodiment of the present invention includes a buoy body configured to provide buoyance; a fixing belt configured to fasten the buoy body to a ship structure; an auto-release unit configured to release the buoy body to be buoyed by releasing the fixing belt when a predetermined water pressure is reached; and an auto-reel chain box fixed to the ship structure, being opened in conjunction with releasing of the fixing belt, and including a chain which is reeled out when the buoy body is buoyed, wherein the auto-reel chain box comprises: a weight provided in the auto-reel chain box and being movable upward and downward according to a water pressure and buoyance; a pulley provided in the auto-reel chain box, having the chain wounded thereon and a plurality of teeth on an outer circumferential surface thereof; and a shaft having one end connected to the weight and the other end engaging with the teeth to fix the pulley and provided to be rotatable around a portion fixed in the auto-reel chain box.

4 Claims, 6 Drawing Sheets

(56) References Cited

U.S. PATENT DOCUMENTS

| | | | | | |
|---|---|---|---|---|---|
| 4,781,636 | A * | 11/1988 | Schurr | B63B 22/18 | 242/395 |
| 5,141,458 | A * | 8/1992 | Church | B63B 22/04 | 441/26 |
| 5,256,093 | A * | 10/1993 | Balstad | B63B 22/04 | 441/21 |
| 5,803,780 | A * | 9/1998 | Gutierrez, Jr. | B63B 22/18 | 43/43.1 |
| 6,086,439 | A * | 7/2000 | Vasile | B63B 22/00 | 441/25 |
| 6,227,766 | B1 * | 5/2001 | Cook | B63B 22/166 | 405/185 |
| 6,383,045 | B1 * | 5/2002 | Eckardt | B63B 22/18 | 440/16 |
| 7,001,235 | B2 * | 2/2006 | Baldwin | B63B 22/22 | 441/30 |
| 7,175,492 | B1 * | 2/2007 | Butler | B63B 22/04 | 441/26 |

FOREIGN PATENT DOCUMENTS

| | | | |
|---|---|---|---|
| KR | 10-2011-0117611 | A | 10/2011 |
| KR | 20-2011-0010104 | U | 10/2011 |
| KR | 10-2017-0033562 | A | 3/2017 |

* cited by examiner

AUTO-RELEASABLE NEW DANGER MARK BUOY

CROSS REFERENCE TO RELATED APPLICATIONS AND CLAIM OF PRIORITY

This application claims benefit under 35 U.S.C. 119(e), 120, 121, or 365(c), and is a National Stage entry from International Application No. PCT/KR2017/002276 filed Mar. 2, 2017, the entire contents of which are incorporated herein by reference.

TECHNICAL FIELD

The present invention relates to a buoy, and particularly, to an auto-releasable danger mark buoy.

BACKGROUND ART

The International Association of Marine Aids to Navigation and Lighthouse Authorities (IALA) defines a newly discovered hazard, which has not yet been shown in nautical documents and publications, such as navigational charts, as a "New Danger". A "new danger" includes natural hazards, such as shoals and rocks, and man-made hazards, such as wrecks. These new dangers should be marked using appropriate marks, such as lateral marks, cardinal marks, isolated danger marks, and the like, or using an emergency wreck marking buoy. When the competent authority considers the hazard to be especially important, at least one of the marks should be installed in duplicate. When a ship sinks or a hazard (an artificial structure, a natural rock, etc.) is newly discovered, it may threaten the safety of a ship's navigation, and thus in order to prevent a further accident, shapes, colors and lighting of new danger marks which are to be installed at the position of the danger by the competent authority are defined as follows.

TABLE 1

| | | Description |
|---|---|---|
| | Color | Blue and yellow vertical stripes in equal number and dimensions (minimum of 4 stripes and maximum of 8 stripes) |
| | Shape of buoy | Pillar or spar |
| | Top mark (if fitted) | Standing/upright yellow cross |
| Light | Color | Alternating yellow/blue flashing light |
| | Rhythm | Blue and yellow alternating 1 second flashes with an interval of 0.5 seconds |

However, issues on practical installation and operation are raised due to the speed of installation of light buoys and problems in installation and removal. Also, in the case of a ship sinking accident, it is difficult to install the new danger mark when the weather condition, characteristics of the sea area, and the exact location cannot be confirmed.

In regard to international regulations relating to wreck buoys, IALA has relevant provisions in NAVGUIDE, the contents thereof are as described above. According to IALA recommendation O-133, "New Danger" is appropriately marked using lateral marks, cardinal marks, emergency wreck marking buoys, and the like, and when information concerning the "New Danger" has been sufficiently promulgated or the danger otherwise resolved, the marking of the danger may be removed. In regard to IALA recommendation O-133(2006.), "Emergency Wreck Marking Buoy," issues on the effective responses required to prevent collisions and other dangers were raised due to the wreck of the 'Tricolor' in the Dover Straits in 2002, and accordingly, new emergency wreck marking buoys were suggested. IALA Guideline No. 1046 (Response Plan for the Marking of New Wrecks) provides guidance for an immediate and effective response, whereas it is considered that the existing IALA maritime buoy system would be difficult for navigators to initially recognize marks since hazardous areas are marked using cardinal and lateral marks or isolated danger marks. IALA has adopted Recommendation O-133 (New Wreck Marking Buoy) to mark locations of clearly dangerous wrecks.

As a Korean regulation on wreck buoys, Article 16 (New Danger Mark) of Criteria for Standards and Functions for Aids to Navigation defines that "a New Danger Mark is a mark used to mark newly discovered hazards which have not yet been listed in nautical documents and publications". Here, the hazards may include naturally occurring obstruction, such as sandbags and rocks and man-made dangers, such as wrecks. Regarding installation of the wreck buoys, it is specified in Article 7 (Obligation to Establish Aids to Navigation in Case of Ship Sinking and Stranding) of the Enforcement Decree of the Act on Aids to Navigation (Presidential Decree No. 23786, May, 14, 2012).

With regard to the Korea's current operating status of wreck buoys, in the case of the Cheonan ship accident that occurred off the coast of Baekryeongdo in 2010, it took about one month or more from the accident to the salvage. During this period, the Korean Navy installed buoys that could identify the location, not the standard wreck buoys. It is considered that such buoys were used due to promptness and convenience of installation. According to the press release, the buoys installed at the time of the Cheonan incident were 60 cm in width, 90 cm in length and 240 cm in height, an interior material thereof was Styrofoam while an exterior material was fiber reinforced plastic (FRP) for ships, a sinker was fixed to the underwater mud by hanging a T-shaped anchor thereon, and the buoys were made orange so that they could be easily seen from afar. Also, solar lights were installed on the buoys to charge the solar energy during the day and light up at night. The military assumes that the installation cost would be about 600 million won and the maintenance cost would be about 150 million won if regular buoys of the military were installed, so they installed simple buoys at a cost of about 10 million won.

According to a report on the Incheon Regional Maritime Affairs and Port Office website in 2006, the Incheon Regional Maritime Affairs and Fisheries Office installed two light buoys to mark a location of a sinking ship on Mar. 27, 2006 for the safety of navigation of ships sailing near the location of the Sinhai No. 7 (2,972 tons) which sank about two miles northwest of Yeongheungdo off the coast of Incheon. However, the area where the sinking ship was located is in contact with an area where ships waiting for entry to Incheon Port were anchored, so the area could be used as a passage for large ships. Also, since the corresponding area is in contact with a medium-sized waterway used by small and medium sized ships entering Incheon Port, safety measures for passing ships were needed and accordingly two light buoys were additionally installed on Apr. 3, 2006, thereby preventing the sinking ship from approaching. At this time, four wreck light buoys were installed at about 120 m, north, south, east and west, from the center of the ship stranded point. Therefore, it was expected to contribute greatly to the safety of navigation of ships.

In addition, the passenger ship Sewol, which was on the way from Incheon to Jeju on Apr. 16, 2014, sank in the sea near Jindo and has not been salvaged until now (as of September 2015). Immediately after the Sewol accident, the Ministry of Maritime Affairs and Fisheries installed three metal light buoys in accordance with Article 7 (Obligation to Establish Aids to Navigation in Case of Ship Sinking and Stranding) of the Enforcement Decree of the Act on Aids to Navigation.

With regard to the foreign countries' current operating status of wreck buoys, wreck buoys recommended by IALA are used. In particular, plastics and polystyrene foam materials are used to lighten buoys. The table below shows the current status of lightweight wicker buoys used in foreign countries.

TABLE 2

| Classification | U.K. | France | Spain | Australia |
|---|---|---|---|---|
| Color | | Blue and yellow stripes | | |
| Material | polystyrene foam | — | — | Plastic |
| Size | — | 1485 mm | 1200 mm | 1180 mm |
| Weight | 261 kg | 599 kg | 240 kg | 70 kg |
| Top mark | — | — | ○ | ○ |

According to Table 2, the color conforms to IALA recommendations, the size is 1500 mm or less (within the eye height of adults), the weight is light (especially plastic materials are ultralight in weight), an integrated light lantern utilizing solar cells is adopted, and the installation of the top mark differs from one country to another.

Problems in the operation of the wreck buoys are as follows. In terms of speed, as in the cases of the Cheonan ship accident and the Sewol ship accident, there is a time difference between the date when the sinking occurred and the date when the wreck buoy was installed for the safety of vessel traffic, so that the wreck buoy was installed after a temporary buoy was installed. It can be seen that it is currently difficult to respond immediately due to the problems of legal liability for installation and operation of the wreck buoys and characteristics of the accident area. Also, in terms of the installation and removal of buoys, the current wreck buoys require a lot of manpower and equipment to install due to its own weight, so it is difficult to install the buoy immediately after the port authority receives a position of a wreck. If a merchant ship or a fishing vessel loads a buoy on the assumption that sinking will occur, there are many problems such as a problem caused by buoy's own weight, a problem of requiring a lot of manpower and equipment, a problem of moving the buoy to be stored in a designated place (each buoy management office) after being loaded, and a problem of requiring a crane-installed vessel (service vessel) at the time of loading the buoy to the ship.

SUMMARY

An objective of the present invention is to provide an auto-release danger mark buoy which is a small wreck buoy attached to a ship, wherein the wreck buoy is automatically released from the ship and automatically buoyed by a predetermined water pressure in the occurrence of a marine accident, such as disappearance, overturning, or sinking of the ship, thereby being able to immediately and accurately mark the position of the accident point.

The present invention provides a buoy system including: a buoy body configured to provide buoyance; a fixing belt configured to fasten the buoy body to a ship structure; an auto-release unit configured to release the buoy body to be buoyed by releasing the fixing belt when a predetermined water pressure is reached; and an auto-reel chain box fixed to the ship structure, being opened in conjunction with releasing of the fixing belt, and including a chain which is reeled out when the buoy body is buoyed, wherein the auto-reel chain box includes: a weight provided in the auto-reel chain box and being movable upward and downward according to a water pressure and buoyance; a pulley provided in the auto-reel chain box, having the chain wounded thereon and a plurality of teeth on an outer circumferential surface thereof; and a shaft having one end connected to the weight and the other end engaging with the teeth to fix the pulley and provided to be rotatable around a portion fixed in the auto-reel chain box.

The weight may be provided to move downward at a water pressure at which the fixing belt is released, the shaft may be rotated by the downward movement of the weight so that engagement of the other end of the shaft and the teeth is released, and the chain wound on the pulley may be reeled out as the engagement is released.

The weight may be provided to move upward by the buoyance when the buoy body reaches a surface of water, the shaft may be rotated in an opposite direction by the upward movement of the weight so that the other end of the shaft is engaged again with the teeth, and as the other end of the shaft is engaged with the teeth, the reeling out of the chain may be locked.

The buoy system may further include an auto-lighting lantern installed on an upper portion of the buoy body and including a lamp provided to operate in conjunction with auto-release of the buoy body.

The auto-lighting buoy may include an emergency power device configured to supply power to the lamp and a connection line connected to a switch of the emergency power device and provided to operate the switch at the time of auto-release of the buoy body.

The auto-release unit may include a water pressure measurement device configured to detect whether a water pressure on the buoy body reaches the predetermined water pressure, and hooks engaged with each other in a ring shape to fix the fixing belt and releasing the fixing belt by opening the engaged ring when the water pressure measurement device detects the predetermined water pressure.

According to the present invention, a small wreck buoy attached to a ship can be automatically released and buoyed by a predetermined water pressure in the occurrence of a marine accident, such as disappearance, overturning, or sinking of the ship, thereby immediately and accurately marking the position of the accident point. By the development of this technology, it is expected that further accidents due to the obstruction that threatens the safety of the navigation of the ship in the corresponding area can be prevented and immediate searching and rescue can take place.

DETAILED DESCRIPTION

Figure 1:
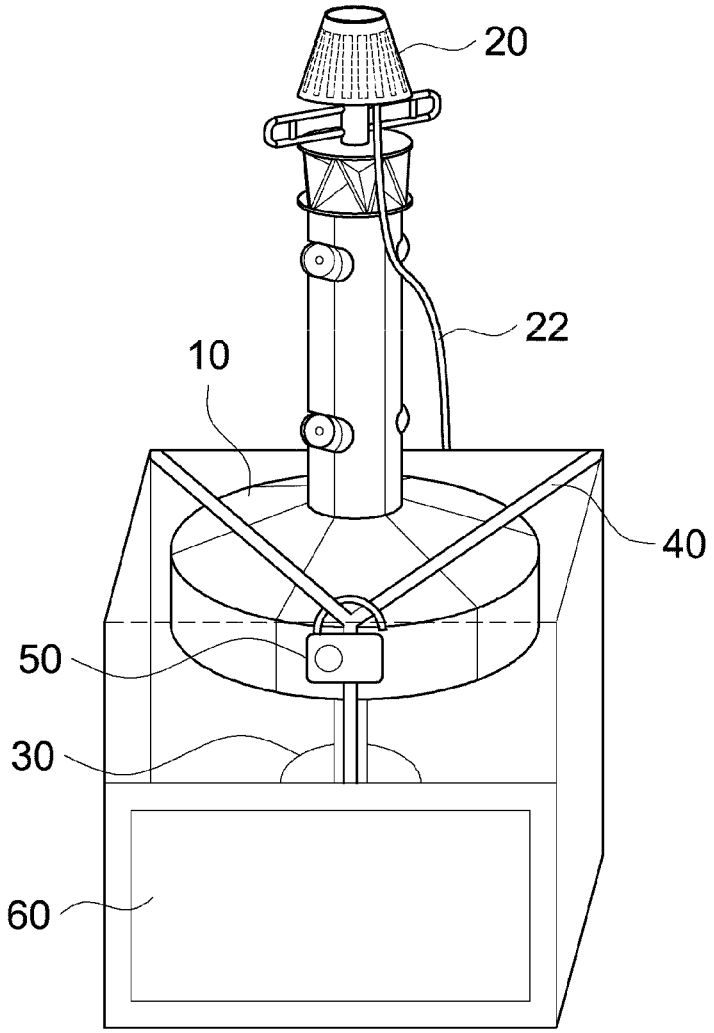
FIG. 1 is a diagram illustrating an entire configuration of a buoy system according to the present invention

The following description is provided to assist the reader in gaining a comprehensive understanding of the methods, apparatuses, and/or systems described herein. Accordingly, various changes, modifications, and equivalents of the methods, apparatuses, and/or systems described herein will be suggested to those of ordinary skill in the art.

Descriptions of well-known functions and constructions may be omitted for increased clarity and conciseness. Also, terms described in below are selected by considering functions in the embodiment and meanings may vary depending on, for example, a user or operator's intentions or customs. Therefore, definitions of the terms should be made on the basis of the overall context. The terminology used in the detailed description is provided only to describe embodiments of the present disclosure and not for purposes of limitation. Unless the context clearly indicates otherwise, the singular forms include the plural forms. It should be understood that the terms "includes" or "includes" specify some features, numbers, steps, operations, elements, and/or combinations thereof when used herein, but do not preclude the presence or possibility of one or more other features, numbers, steps, operations, elements, and/or combinations thereof in addition to the description.

Further, a directional term, such as an "upper portion," a "lower portion," a "one end," "the other end", and the like, is used in relation to orientation of disclosed drawings. Since the elements according to an embodiment of the present invention may be positioned with various orientations, the directional term is used for illustrative purpose, rather than limiting in all aspects.

The present invention relates to automatically releasable wreck marking buoy for marking a new danger on the basis of a maritime buoyage system internationally applied by International Association of Marine Aids to Navigation and Lighthouse Authorities (IALA), and provides a technique for automatically installing a light buoy for marking a new danger immediately upon occurrence of a marine accident, such as disappearance, overturning, or sinking of a ship, and accurately informing the location. A detailed description thereof is as follows.

First, the present invention relates to an automatically releasable light buoy technology for auto-buoyance, which is small and easy to handle and can be automatically buoyed and be installed when a marine accident, such as disappearing, overturning, sinking of a ship, occurs. In the event of a marine accident, a small wreck buoy attached to a ship is automatically released by a certain pressure and automatically buoyed to indicate the location of an accident point, thereby preventing further accidents in the area and facilitating immediate searching and rescue. An auto-release unit for auto-buoyance is designed to usually fix the small wreck buoy located on a deck of the ship, and allow auto-buoyance of the wreck buoy that is automatically released when a predetermined water pressure is applied to an internal water pressure measurement device in the event of a marine accident.

Second, the present invention relates to an auto-reel chain technology, which provides a chain that is automatically reeled out according to a water depth of an accident area when a marine accident occurs, and is automatically fixed when a buoy reaches the sea surface. For auto buoyance of a small wreck buoy that is automatically released in the event of a marine accident of a ship, the chain is automatically reeled out according to the depth of water in the accident area so that the buoy can reach the sea surface. In an illustrative embodiment, the chain may be designed to be reeled out up to 70 m based on the size and a main route of a ship on which the chain is installed, by taking into account a water pressure release device designed to automatically operate at depths between 1.5 and 4 m. Both ends of the chain are connected to the buoy and the ship, respectively, and the remaining loose rope is loaded in the buoy so that it can be automatically reeled out according to a water depth in the event of an accident and can be automatically fixed when the buoy reaches the sea surface.

Third, the present invention relates to an auto-lighting lantern, which is of a watertight type and is automatically turned on to operate as a light buoy is released when the ship sinks. In order for the wreck buoy to clearly indicate the position of the buoy and a point of the ship accident after a marine accident occurs, a lighting lantern is installed on the buoy itself so that it can be automatically lighted.

FIG. 1 is a diagram illustrating an entire configuration of a buoy system according to the present invention, and the buoy system may include a buoy body 10, a lighting lantern 20, a connecting line 22, a weight 30, a fixing belt 40, an auto-release unit 50, and an auto-reel chain box 60.

The buoy body 10 may include a low-density material to provide buoyancy. The buoy body 10 may include a foam structure, for example, polystyrene foam and polyurethane foam. In addition, blue and yellow stripes may be formed in a vertical direction on a surface of the buoy body 10 according to the international standards. The buoy body 10 may be fixed to a buoy mount in the form of a box, which is installed on the ship, via the fixing belt 40.

The lighting lantern 20 is installed on an upper portion of the buoy body 10 and includes a lamp so that the buoy system can be identified at night. The lighting lantern 20 according to the present invention may be an auto-lighting lantern that automatically operates when the buoy body 10 is buoyed.

The weight 30 is installed at a lower portion of the buoy body 10 and is composed of a heavy material, such as metal, to hold the center of gravity of the buoy system.

The fixing belt 40 fastens the buoy body 10 to the ship structure (buoy mount, etc.).

When the ship sinks and reaches a certain pressure, the auto-release unit 50 releases the fixing belt 40 to automatically release and buoy the buoy body 10.

The auto-reel chain box 60 may include a chain 68 which is automatically reeled out when the buoy body 10 is released from the ship and floats.

Figure 2:
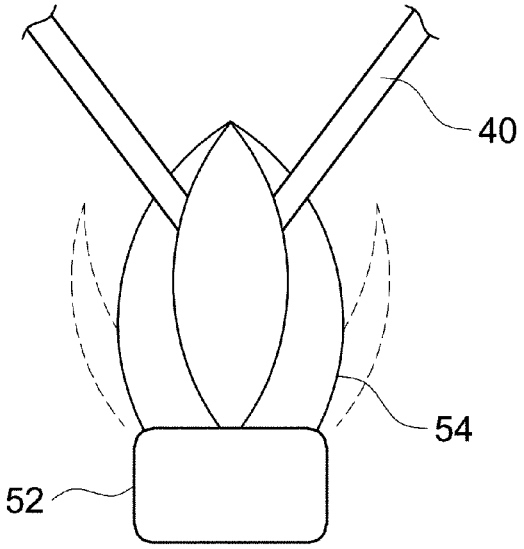
FIG. 2 is a diagram illustrating a configuration of an auto-release unit according to the present invention.

FIG. 2 is a diagram illustrating a configuration of an auto-release unit according to the present invention, and the auto-release unit 50 may include a water pressure measurement device 52 and hooks 54.

The water pressure measurement device 52 measures a water pressure. In an illustrative embodiment, the water pressure measurement device 52 may be designed to measure a pressure corresponding to a water depth of 1.5 to 4 m.

The hooks 54 may be engaged in a ring shape to fix the fixing belt 40. When the water pressure measurement device 53 detects a predetermined water pressure in the event of a marine accident, the engaged hooks 54 may open to release the fixing belt 40.

The fixing belt 40 may fasten the buoy body 10 to the buoy mount. When the hook 54 is opened, as indicated by a dashed line in FIG. 2, in the event of a ship accident, the fixing belt 40 is released so that the buoy body 10 can be released and buoyed.

Figure 3:
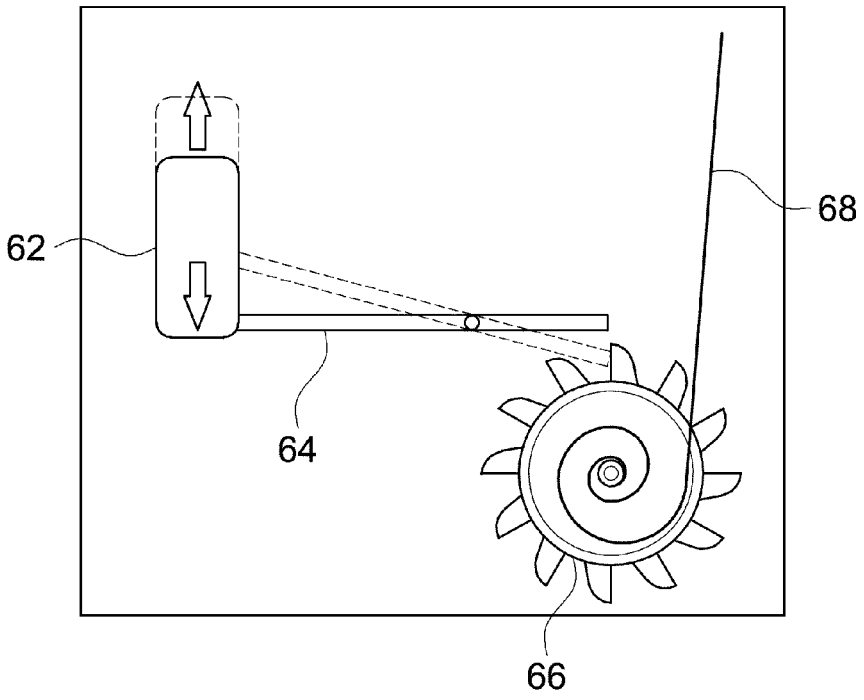
FIG. 3 is a diagram illustrating a configuration of an auto-reel chain system according to the present invention.

FIG. 3 is a diagram illustrating a configuration of an auto-reel chain system according to the present invention, and the auto-reel chain system may include an auto-reel chain box 60, a weight 62, a shaft 64, a pulley 66, a chain 68, and the like. Here, the weight 62, the shaft 64, and the pulley 66 serve as a driving device to reel out the chain 68.

That is, the auto-reel chain box 60 may be a box fixed onto the ship (e.g., a buoy mount) in order to store the driving device and the chain (rope) 68, and may be provided to operate in conjunction with opening of engaged hooks 54 of an auto-release unit 50.

The weight 62 may be installed inside the chain box 60 and may be provided to move up and down according to a water pressure and buoyance. The weight 62 is connected to the shaft 64 to rotate the shaft 64.

One end of the shaft 64 may be coupled to a lower part of the weight 62. The other end of the shaft 64 may engage with one of a plurality of teeth of the pulley 66. The shaft 64 may be provided in a horizontal direction that is perpendicular to a vertical direction of the weight 62 in the chain box 60. The shaft 64 may be partially fixed to the chain box 60 and may be installed to be rotatable about the fixed portion. The shaft 64 may be rotated by an up and down movement of the weight 62 to engage with the teeth of the pulley 66 or to disengage from the teeth.

The pulley 66 may be rotatably installed in the chain box 60. The chain 68 is wound on the pulley (66), and may have a plurality of teeth provided on an outer circumferential surface thereof. The size, number, spacing, and the like of the teeth may be suitably designed so that the teeth can engage with the shaft 64.

The chain 68 may connect the buoy body 10 with the ship structure. The chain 68 may be automatically reeled out according to the water depth of an accident area when the buoyant body 10 is buoyed after being released.

Hereinafter, operations of the auto-reel chain system will be described. When the weight 62 moves downward due to a water pressure caused by the sinking of the ship in the event of an accident, the shaft 64 rotates about the fixed portion in the chain box 60 and the other end of the shaft 64 is moved upward. At this time, engagement of the other end of the shaft 64 and the teeth of the pulley 66 is released. Then, the chain 68 wound on the pulley 66 is automatically released from the pulley 66 while the automatically released buoy body 10 floats, and the buoy body 10 reaches the surface of the water.

Meanwhile, when the sinking ship reaches the seabed, the weight 62 stops for a moment and then moves upward by buoyancy. Then, the shaft 64 rotates about the portion fixed in the chain box 60, and the other end of the shaft 64 is moved downward. At this time, the other end of the shaft 65 is engaged again with the teeth of the pulley 66. As a result, unwinding of the chain 68 is stopped as the pulley 66 is fixed by the shaft 64, so that the chain 68 can be automatically fixed.

Figure 4:
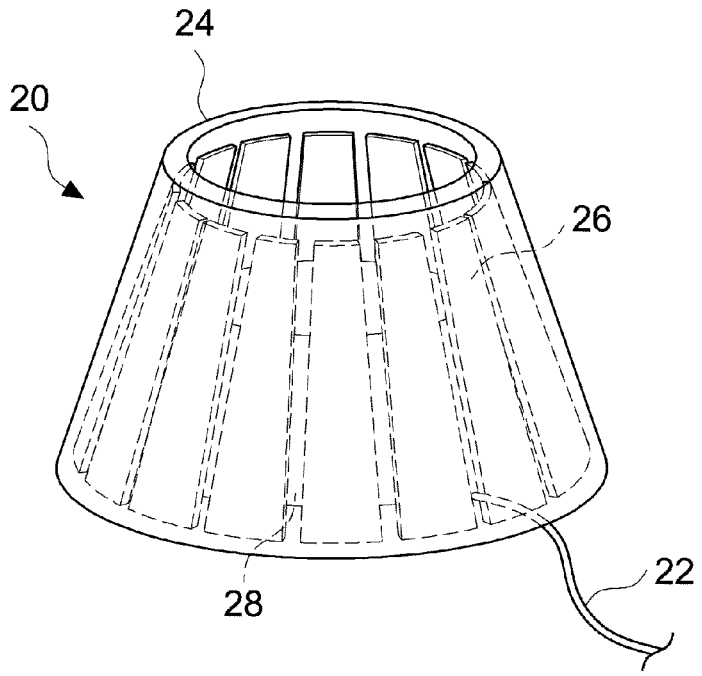
FIG. 4 is a diagram illustrating an auto-lighting lantern according to the present invention.

FIG. 4 is a diagram illustrating an auto-lighting lantern according to the present invention, and the auto-lighting lantern may be a watertight structure type lantern that automatically operates and indicates a location when a light buoy automatically released from the buoy mount floats in the event of a marine accident. The whole light lantern may be a watertight structure, and an automatic driving device is installed therein so that it can automatically operate when the light buoy is released.

An auto-lighting lantern 20 may include a connection line 22, a watertight case 24, a lamp (not shown), a solar panel 26, and an auto-driving device 28.

One end of the connection line 22 may be fixed to a light buoy mount and the other end of the connection line 22 may be connected to a switch of the auto-driving device 28. The connection line 22 serves to automatically supply power to the lighting lantern 20 by operating the switch of the auto-driving device 20 when the light buoy is released.

The watertight case 24 is a sealed case and serves to protect the lamp, the solar panel 26, the auto-driving device 28, and the like, which are installed therein. The watertight case 24 may be made of a material, such as plastic, to ensure watertightness. The watertight case 24 may be made of a transparent material such that the solar panel 26 can absorb sunlight.

At least one, preferably, a plurality of lamps (not shown) may be installed in the watertight case 24. The lamp may be configured with a light emitting diode (LED) or an organic LED (OLED).

At least one, preferably, a plurality of solar panels 26 may be installed in the watertight case 24. When the buoy body 10 is buoyed to the surface of the water, the buoy body 10 can be continuously operated by being supplied with power from the solar panel 26.

The auto-driving device 28 is installed in the watertight case 24 and serves to drive the lamp. The auto-driving device 28 may include an emergency power device (not shown) and a switch (not shown) connected to the emergency power device. When the buoy body 10 is released from the ship, the switch is operated by the connection line 22 so that the lamp can be operated by emergency power. The emergency power device may be a battery.

Figure 5:
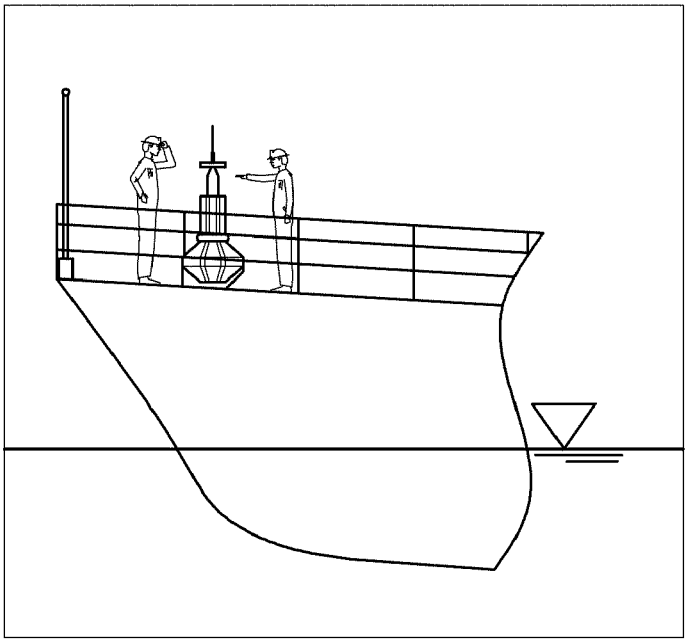
FIG. 5 shows a state in which the buoy system according to the present invention is installed in a ship.

FIG. 5 shows a state in which the buoy system according to the present invention is installed in a ship, and the buoy system may be installed on a deck of the ship, for example, on a buoy mount.

Figure 6:
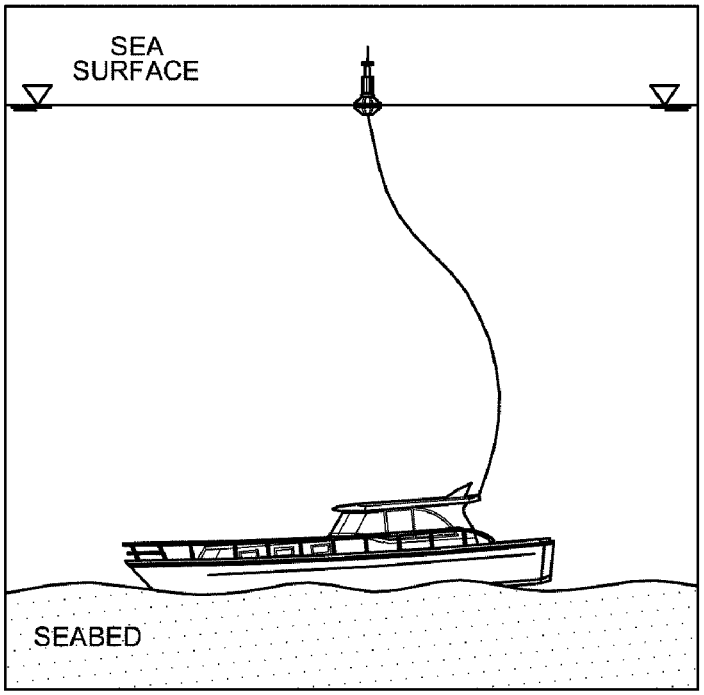
FIG. 6 shows a state in which the buoy system according to the present invention operates to be buoyed to the sea surface according to the sinking of the ship.

FIG. 6 shows a state in which the buoy system according to the present invention operates to be buoyed to the sea surface according to the sinking of the ship, and shows a state in which, as the ship sinks, the buoy system is automatically released and then is buoyed to the sea surface by an automatic extension chain.

The auto-lighting lantern is designed to operate at the same time as it is released from the ship, and the requirements thereof are reviewed through corrosion resistance test, temperature repetition test, strength test, and the like, as follows:

TABLE 3

| Requirement | Description |
|---|---|
| Corrosion resistance test | Temperature: 35 ± 3° C.<br>Exposure time: 160 minutes<br>Salt water: Salt water spray with 5% sodium chloride solution |
| Temperature repetition test | Temperature −30 to 60° C.<br>Exposure time: 8 hours<br>Times of repetition: 9 times repeated |
| Strength test | Load: minimum tensile load of 10 kN<br>Exposure time: 30 minutes |
| Others | Watertightness test: assessment of watertightness within 10 m of water depth<br>Operating time test: evaluation of maximum operating time of lighting lantern |

A number of examples have been described above. Nevertheless, it will be understood that various modifications may be made. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

The invention claimed is:

1. A buoy system comprising:

a buoy body configured to provide buoyance;

a fixing belt configured to fasten the buoy body to a ship structure;

an auto-release unit configured to release the buoy body to be buoyed by releasing the fixing belt when a predetermined water pressure is reached; and an auto-reel chain box to be fixed to the ship structure, being opened in conjunction with releasing of the fixing belt, the auto-reel chain box comprising:

a chain which is reeled out when the buoy body is buoyed;

a weight provided in the auto-reel chain box and being movable upward and downward according to a water pressure and buoyance;

a pulley provided in the auto-reel chain box, having the chain wounded thereon and a teeth on an outer circumferential surface thereof; and a shaft having a first end connected to the weight, a second end engaging with the teeth to fix the pulley and a portion fixed to the auto-reel chain box, the shaft provided to be rotatable around the portion fixed to the auto-reel chain box.

2. The buoy system of claim 1, wherein the weight is provided to move downward at a water pressure at which the fixing belt is released;

the shaft is rotated by a downward movement of the weight so that engagement of the second end of the shaft and the teeth is released; and the chain wound on the pulley is reeled out as the engagement is released.

3. The buoy system of claim 2, wherein the weight is provided to move upward by the buoyance when the buoy body reaches a surface of water;

the shaft is rotated in an opposite direction by an upward movement of the weight so that the second end of the shaft is engaged again with the teeth; and as the second end of the shaft is engaged with the teeth, reeling out of the chain is locked.

4. The buoy system of claim 1, wherein the auto-release unit includes:

a water pressure measurement device configured to detect whether a water pressure on the buoy body reaches the predetermined water pressure; and hooks engaged with each other in a ring shape to fix the fixing belt and releasing the fixing belt when the water pressure measurement device detects the predetermined water pressure.

* * * * *